US005747148A

United States Patent [19]

Warner et al.

[11] Patent Number: 5,747,148

[45] Date of Patent: May 5, 1998

[54] INK JET PRINTING SHEET

[75] Inventors: David Warner, Maplewood; Charles C. Lee, Little Canada; Wu-Shyong Li, Woodbury, all of Minn.

[73] Assignee: Minnesota Mining and Manufacturing Company, St. Paul, Minn.

[21] Appl. No.: 554,256

[22] Filed: Nov. 6, 1995

Related U.S. Application Data

[63] Continuation-in-part of Ser. No. 335,986, Nov. 8, 1994, abandoned, which is a continuation-in-part of Ser. No. 304,803, Sep. 12, 1994, abandoned.

[51] Int. Cl.[6] ..... B41M 5/00

[52] U.S. Cl. ..... 428/212; 428/195; 428/206; 428/323; 428/327; 428/341; 428/342; 428/408; 428/500

[58] Field of Search ..... 428/195, 327–331, 428/212, 211, 537.5, 206, 323, 341, 342, 408, 500

[56] References Cited

U.S. PATENT DOCUMENTS

| | | | |
|---|---|---|---|
| 4,379,804 | 4/1983 | Eisele et al. | 428/332 |
| 4,935,307 | 6/1990 | Iqbal et al. | 428/500 |
| 5,045,391 | 9/1991 | Brandt et al. | 428/336 |
| 5,084,338 | 1/1992 | Light | 428/337 |
| 5,108,865 | 4/1992 | Zwaldo et al. | 430/126 |
| 5,114,520 | 5/1992 | Wang, Jr. et al. | 156/240 |
| 5,120,601 | 6/1992 | Kotaki et al. | 428/327 |
| 5,132,146 | 7/1992 | Maruyama et al. | 427/261 |
| 5,206,071 | 4/1993 | Atherton et al. | 428/195 |
| 5,208,092 | 5/1993 | Iqbal | 528/195 |
| 5,262,259 | 11/1993 | Chou et al. | 430/47 |
| 5,275,867 | 1/1994 | Misuda et al. | 428/195 |
| 5,302,437 | 4/1994 | Idei et al. | 428/195 |
| 5,342,688 | 8/1994 | Kitchin et al. | 428/402 |
| 5,389,723 | 2/1995 | Iqbal et al. | 525/57 |

FOREIGN PATENT DOCUMENTS

| | | | |
|---|---|---|---|
| 0 350 257 | 1/1990 | European Pat. Off. . | |
| 0 350 257 A1 | 1/1990 | European Pat. Off. | B41M 1/30 |
| 0 484 016 A1 | 5/1992 | European Pat. Off. | B41M 5/00 |
| 0 500 021 A1 | 8/1992 | European Pat. Off. . | |
| WO 96/08377 | 3/1996 | WIPO . | |

*Primary Examiner*—Pamela R. Schwartz
*Attorney, Agent, or Firm*—Gary L Griswold; Walter N. Kirn; John H. Hornickel

[57] ABSTRACT

This invention relates to an ink jet printing sheet having a particle filled ink receptor layer and a particle filled protective penetrant layer. The particles from both the ink receptor layer and protective penetrant layer cause protrusions from the protective penetrant layer.

10 Claims, 3 Drawing Sheets

INK JET PRINTING SHEET

CROSS REFERENCE TO RELATED PATENT APPLICATIONS

This application is a continuation-in-part application of U.S. patent application Ser. No. 08/335,986, filed Nov. 8, 1994, now abandoned, which is a continuation-in-part application of U.S. patent application Ser. No. 08/304,803, filed Sep. 12, 1994 now abandoned. Both applications are incorporated by reference herein.

TECHNICAL FIELD

This invention relates to ink jet printing sheets suitable for use in signing applications and in particular to a printing sheet having a release surface in contact with an adhesive layer. This invention further relates to a method of printing using the printing sheet of this invention.

BACKGROUND OF THE INVENTION

Various processes suitable for producing outdoor durable signs are known to the art, e.g. by electrostatic printing processes, receptors and methods of transfer to signing materials. These processes have produced materials useful in a whole variety of applications such as advertising, billboards, vehicle signing. However, they suffer from the disadvantage that the machinery requirements for these processes and articles are expensive and the machinery requires relatively high maintenance and operator skill.

The ink jet printing process is now well known. Examples of its applications are as computer printers for the production of documents and overhead transparencies. Recently wide format printers have become commercially available, and therefore the printing of larger articles such as large engineering drawings, blueprints and color posters and signs has become feasible. These printers are relatively inexpensive as compared with many other hardcopy output devices, for example, digital electrostatic printers. However, the printers have all the usual advantages of computer addressed hardcopy output devices, wherein the image as a positive photographic transparency or print can be scanned using scanner devices known in the art, stored on computer disc, manipulated, restored, and printed etc.

Generally, ink jet inks are wholly or partially water-based and receptors for these inks are typically plain papers or preferably specialist ink jet receptor papers, which are treated or coated to improve their receptor properties or the quality of the images resulting therefrom.

Many ink jet receptor compositions suitable for application as overhead transparencies are also known in the art. These are composed of transparent plastic materials such as polyester, which alone will not accept the aqueous inks and are coated with receptor layers. Typically these receptor layers are composed of mixtures of water soluble polymers that can absorb the aqueous mixture from the ink jet ink.

Examples of ink jet receptor compositions used for overhead transparencies are disclosed in U.S. Pat. No. 4,935,307 (Iqbal et al.); U.S. Pat. No. 5,208,092 (Iqbal); U.S. Pat. No. 5,342,688 (Kitchin et al.); and EPO Publication 0 484 016 A1.

A common problem with images produced by ink jet is the subsequent spread of the dyes, often particularly bad under warm and humid conditions. Therefore, many receptor materials contain moieties that react with, or otherwise immobilize the dyes after printing. Alternative approaches to prevent the spread of dyes are to modify ink formulations.

Another disadvantage with many current ink jet compositions is color shift or fading of the dyes in the images with subsequent loss of the archivability, change in image quality with time, and a short lifetime for relatively high-quality images in direct sunlight. This is not a problem in applications such as short-term signing, for example for advertisements. However, these disadvantages make the images unsuitable for longer term applications such as archivable prints or exterior durable images and signs.

Other ink jet recording materials are disclosed in U.S. Pat. No. 5,132,146 (Maruyama et al.) and U.S. Pat. No. 5,302,437 (Idei et al.).

There is a need for ink jet receptor materials that provide high density, low dye bleed images with dye-based ink jet inks and at the same time provide smear-resistant images with pigmented ink jet inks.

SUMMARY OF THE INVENTION

Briefly, in one aspect of the present invention, an ink jet printing sheet is provided comprising a substrate and an image receiving layer contacting the substrate, wherein the image receiving layer comprises of at least one protective penetrant layer of one composition and at least one ink jet receptor layer of a second composition, and wherein the ink jet receptor layer contains dispersed particles or particulates of a size that causes protrusions from the protective penetrant layer.

Optionally, on the side of the substrate opposite from the image receiving layer, in sequential order, is an adhesive layer and a release liner. The sheet is useful in ink jet printing processes using substrates that may be used in signing, archiving or other imaging applications.

Advantageously, the image receiving layer (either comprised of a single layer or multiple layers) can be used with a wide variety of substrates, such as thermoplastic, thermoset, plastic-coated papers, fabrics, plastic-coated fabrics, thick or thin substrates, provided the coated substrates are capable of being loaded into an ink jet printing system.

The printed receptor sheet, either overlaminated with a protective film or coating or otherwise treated to provide a durable surface can be used for commercial signage, archival or imaging applications.

An advantage of the present invention is an ink jet printing sheet wherein the substrate and adhesive are durable for periods of several years in an exterior environment where the materials and images can be exposed to rain, sun, and such variations in temperature as are found in exterior environments and on surfaces in exterior environments. Typically, the articles of the present invention have some flexibility such that it may be adhered onto surfaces having some curvature or non uniformity e.g. walls or surfaces with screw heads or rivets, without easily ripping the material or cracking or delamination of the image receiving layers, overlaminating layers, other coatings or image or "tenting" of the material over the protrusion.

A degree of water resistance, additional image protection to scratches, splashing and the like, and a high gloss finish can be supplied optionally to the printed sheet, e.g. by the overlamination of a clear protective layer.

Finally, the articles of the present invention maintain other desirable properties of an ideal ink jet printing sheet, such as, dye bleed resistance and low background color. Good color saturation and density are also observed in the printed images. The printed articles do not curl excessively on exposure to humidity or during the ink jet printing process, and printed images exhibit quick ink drying times following printing with good image sharpness.

As used in this application:

"colorant" means any substrate that imparts color to another material or mixture and maybe either, dyes or pigments;

"durable" means the substrates used in the present invention are capable of withstanding the wear and tear associated with signage and may be 2 to 5 years in exterior environments;

"plastic" means a material that is capable of being shaped or molded with or without application of heat and include thermoplastics types, thermosets types, both of which may be flexible, semi-rigid or rigid, brittle or ductile;

"smear-resistant" as used in this application means resistant of the ink jet ink to smear as described in the following test, printing an image with black lines, allowing a minimum of five minutes time to dry, rubbing the line with the pad of the finger with a light to moderate pressure, such as might be used during normal handling of images, and observing whether spread of the line occurs.

DESCRIPTION OF THE PREFERRED EMBODIMENT(S)

Figure 1:
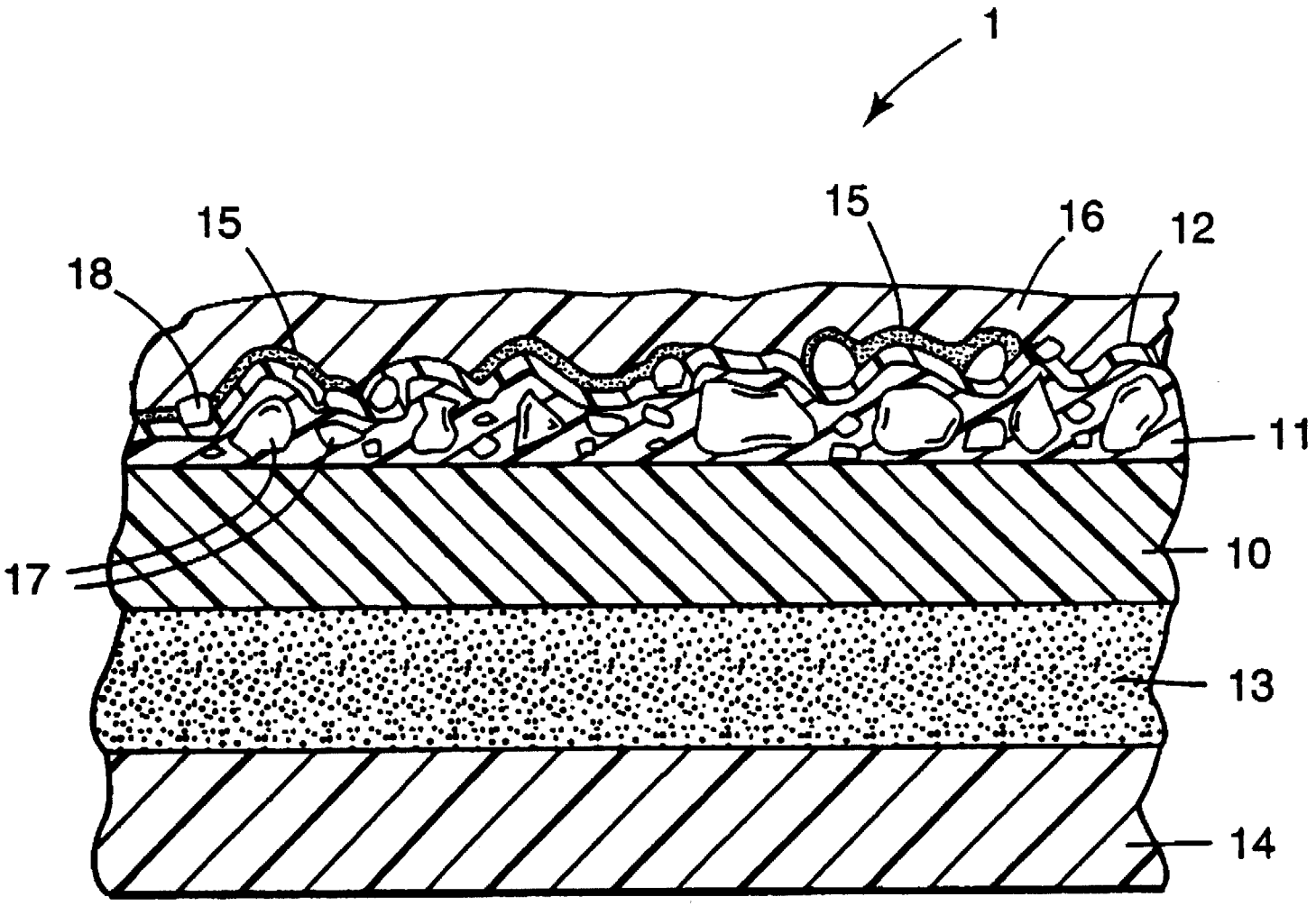
FIG. 1 is a plan end view of a two-layer image receiving layer construction after printing and overlamination.

Referring to FIG. 1 an ink jet printing sheet (1) of the present invention is illustrated comprising (a) an image receiving layer (11–12) on (b) a substrate (10), wherein the sheet may optionally have (c) a layer of adhesive (13) coated or laminated to the substrate (10) on the surface away from the image receiving layer (11–12). The adhesive layer (13) may or may not be backed with release liner (14). In this embodiment (FIG. 1), the image receiving layer (11–12) comprises at least two layers, wherein one layer is a protective penetrant layer (12) and one layer is an ink jet receptor layer (11).

Once the ink jet printing sheet has been imaged with ink jet ink (shown as patches of dried ink containing pigment particles) (15) using an ink jet printing process, the printed sheet (1) may be overlaminated with a transparent protective layer (16). The transparent protective layer (16) may be a transparent plastic sheet bearing on one side a pressure-sensitive adhesive or hot-melt (thermal) adhesive, or a clear coat, or a processing technique that will affect the surface of the printed sheet (1).

Both ink jet receptor layer (11) and protective penetrant layer (12) have particles (17) and (18), respectively, that contribute to the performance of the printed sheet.

Typically, a release liner (14) comprises a paper or plastic or other suitable sheet material coated or otherwise treated with a release material such as a silicone or fluorocarbon type material on at least one surface in contact with adhesive layer such that adhesive layer adheres to release layer but is easily removed from the release liner when desired so that the adhesive layer is exposed.

Substrates

Substrates are preferably a durable material that resists deleterious effects of exterior signing environments including large ambient temperature ranges −60° C. to +107° C., direct exposure to sun and is optionally conformable for fixing to exterior surfaces wherein it may be adhered over surfaces with some curvature or non uniformity e.g. walls or surfaces with screw heads or rivets slightly proud of the surface without easily ripping the material or "tenting". However, the invention need not be limited to these, a less durable plastic is useful for interior signing applications such as might be used when images printed have been printed with dye-based ink jet inks.

Substrates can be clear, translucent, or opaque depending on the application of the invention. Opaque substrates are useful for viewing an image from the image side of the printed sheet in lighting conditions such as artificial lighting or sunlight. Translucent substrates are particularly useful for backlit usages, for example, a luminous sign.

Substrates useful in the practice of the present invention are commercially available and many are designed to be exterior durable, which is preferred.

Nonlimiting examples of such substrates include Scotchcal™ Marking Films and Scotchcal™ Series 9000 Short-Term Removable (STR) Film available from 3M Company, Avery™ SX™ Series Long Life Films, Avery™ XL™ Series Long Life Films, Avery™ SX™ Series Long Life Films, suitable films from the FasCal™ or FasFlex™ range of films or any other suitable marking, graphic or promotional films available from Fasson, Avery or Meyercord. However, other manufacturers of suitable materials exist and the invention shall not be limited to the above. Almost any material composed of a plastic sheet could be used depending on the use of the final image, for example, whether outdoor durability is required, and providing that the ink jet receptor bottomcoat can adhere to the film surface sufficiently well.

Useful substrates can have a variety of surface finishes such a matte finish as provided with Scotchcal™ Series 9000 Short-Term Removable (STR) Film or glossy finish as provided with Scotchcal™ 3650 Marking Film. Plastic films can be extruded, calendared or cast different plastic materials may be used, such as those exemplified by the Scotchcal™ plasticized poly(vinyl chloride) or Surlyn, a polyolefin. Any suitable plastic material can be employed. Nonlimiting examples include polyester materials exemplified by Mylar™ available from E. I. Du Pont de Nemours & Company, Melinex™ available from Imperial Chemicals, Inc., and Celanar™ available from Celanese Corporation. Other examples include polyolefins such as polyethylene and polypropylene, polycarbonates, polymerized acrylates, polystyrene, polysulfones, polyether sulfones, cellulose triacetate, cellophane, poly(vinyl fluoride), polyimides, Teslin™ available from PPG Industries, rubbery polymers such as styrene-butadiene copolymers, nitrile or butyl rubbers, polybutadienes. Preferred materials for substrates can include those that are plasticized poly(vinyl chloride)s or ionomers although the invention is not limited to these. Preferred materials are white opaque or translucent materials but transparent materials and colored opaque, translucent or transparent materials could be useful in special applications.

Typical thicknesses of the substrate (10) are in the range of 0.05 to 0.75 mm. However, the thickness can be outside this range and almost any thickness can be useful provided the film resists tearing or splitting during the printing and application process. Given all considerations, any thickness is useful provided the substrate is not too thick to feed into an ink jet printer of choice.

Imaging Receiving Layer

The image receiving layer is comprised of at least two layers, such that at least one of the layers functions as an ink jet receptor (11). When the image receiving layer is comprised of at least two layers, the uppermost layer functions as a protective penetrant layer (12) and the bottomcoat layer functions as the ink jet receptor (11).

Although an image receiving layer is described as a multilayer construction, the use of the term "multilayer" does not necessarily imply that the layers are wholly distinct, that is, there is a discernible demarcating interface, although they may be. There may be, for example, some interlayer mixing especially at the interface during a coating procedure.

To prepare layers (11) and (12) generally, typical hydrophilic or water soluble or water absorbent polymers or binders used in the art are poly(vinyl pyrrolidone), copolymers of vinyl pyrrolidone e.g. with ethylene or styrene, poly(vinyl alcohol), polyacrylic acids, polymethacrylic acids or (1-alkyl) acrylic acid copolymers and the inorganic salts such as alkali metal salts derived therefrom, poly (alkylene oxides) or polyglycols, carbohydrates, alkyl and hydroxylalkyl cellulose derivatives, starch and starch derivatives such as hydroxyalkyl starches, carboxyalkyl celluloses and their salts, gum arabic, xanthan gum, carageenan gum, proteins and polypeptides. One or more polymers can be crosslinked by employing other reactants or catalysts.

Preferred constituents of the bottomcoat layer (11) include copolymers as disclosed in EP 0484016 A1, poly (vinyl pyrrolidone), poly(ethylene oxide), and mordants such as are described in U.S. Pat. No. 5,342,688 to hinder dye migration in images after printing. However, mordants are not required in printing sheet designed for use with pigment-based ink jet inks.

Preferred constituents of the topcoat layer (12) are hydrophilic or water-soluble polymers, gums and surfactants which are less sensitive to humidity and moisture from the touch than for example is poly(vinyl pyrrolidone). These include poly(vinyl alcohol), aforementioned particulates such as corn starch or their derivatives or modified corn starches, Xanthan gum and surfactants such as Triton X-100. A similar topcoat is described in U.S. Pat. No. 4,935,307 and such description is incorporated herein by reference.

It is preferable to use an image receiving layer having a two layer construction wherein both the bottomcoat layer (11) and topcoat layer (12) contain a dispersed particle or particulate (17) and (18), respectively, such that the surface of the ink jet printing sheet is roughened. As depicted in FIG. 1, the roughened surface is characterized by dispersed particles and/or particulates such that images printed using pigment-based ink jet inks in the ink jet printing process are essentially non-smearable or smear resistant. Filling the bottomcoat layer (11) with particulate matter (17) can achieve a roughened receptor surface. Other advantages may also be gained such as improved grip in the ink jet printer and improved transport of the article of the invention through the printer and the prevention of "blocking."

Typical thicknesses of bottomcoat layer (11) are in the range from about 2 to about 30 μm. Desireably, such thickness ranges from about 5 to about 30 μm, because it is desirable for particles (17) to extend above an otherwise level surface of bottomcoat layer (11). Preferably, such thickness ranges from about 5 to about 20 μm, because it is preferred to provide protrusions or hills with particles (17) that not only affect the terrain or topology of bottomcoat layer (11) but also the terrain or topology of topcoat layer (12). As seen in FIG. 1, the protrusions can be caused not only from layer particles that themselves cause protrusions, but also from smaller particles that become "stacked together" and cause protrusions, when sufficient concentration of particles are in the layer.

Typical thicknesses of topcoat layer (12) are in the range of from about 0.05 to about 4 μm, as measured from the lowermost valley in the terrain or topology of bottomcoat layer (11). As described in detail below, desirable thicknesses of topcoat layer (12) can range from about 0.05 to about 3 μm. Preferably, such thickness can range from about 0.05 to about 2 μm.

Thicknesses for both layers (11) and (12) are based on dry coating weights that are based on the coating solutions and coating thicknesses according to techniques known to those skilled in the art.

Generally, the thickness of the topcoat layer (12) is much thinner than the bottomcoat layer (11). Depending on the printing application, the thicknesses may vary. Relative to each other, the particles and/or particulates (17) contained in the bottomcoat layer (11) preferably should be larger than the thickness of the topcoat layer (12) and the thicknesses of layer (11) so that such particles (17) cause protrusions from not only layer (11) but also layer (12).

Preferred materials for such dispersed particles and particulate material (17) and (18) include materials that are insoluble or of sufficient low solubility in the rest of the ink jet coating mixture that is typically aqueous. Preferred are materials that have some water absorbency. Nonlimiting examples of particulate material include corn starch or modified corn starches, silica, alumina, titanium dioxide or other white inorganic oxide or hydroxide materials, cotton or flock particles and other cellulose or modified cellulose particulates, calcium carbonate or calcium silicate and other white inorganic silicates, sulfides and carbonates, clays, and talc. The size of the dispersed particles or particulates (17) and (18) are typically in the range of approximately 1 to 40 micrometers in diameter, preferably in the range of approximately 2 to 20 micrometers in diameter. However, it is not intended that the invention be limited to this range, provided there are sufficient particles have sizes large enough to roughen the surface of the bottomcoat and topcoat layers (11) and (12). The enumerate size distribution is a typical range, although it permissible to use particles or particulates that are outside the above-stated range of sizes. Particles and/or particulates (17) and (18) are added into the image receiving layers (11) and (12) in the range of 10 to 60% by weight of total solids, preferably in the range of 15 to 25% by weight of total solids. Furthermore, dispersed particles and particulates are generally available in a distribution of sizes, although it is not intended to forclose the use of a single sized particle or particulate, provided the size is large enough as described above.

Adjuvants to the receptor coatings include but are not limited to water soluble polymers or mixtures of water-soluble polymers acting as absorbent materials or binders or both, crosslinked materials or other polymers, and optionally other materials such as surfactants, crosslinkers, mordants to prevent dye bleed or other dye migration in the printed image, other moieties for the prevention of dye-bleed, and dispersions or emulsions. Ultraviolet radiation absorbing materials, free radical scavangers and antioxidants may also be used. The amounts used of any of the adjuvants are those typical for the adjuvant selected and known to those skilled in the art.

Figure 2:
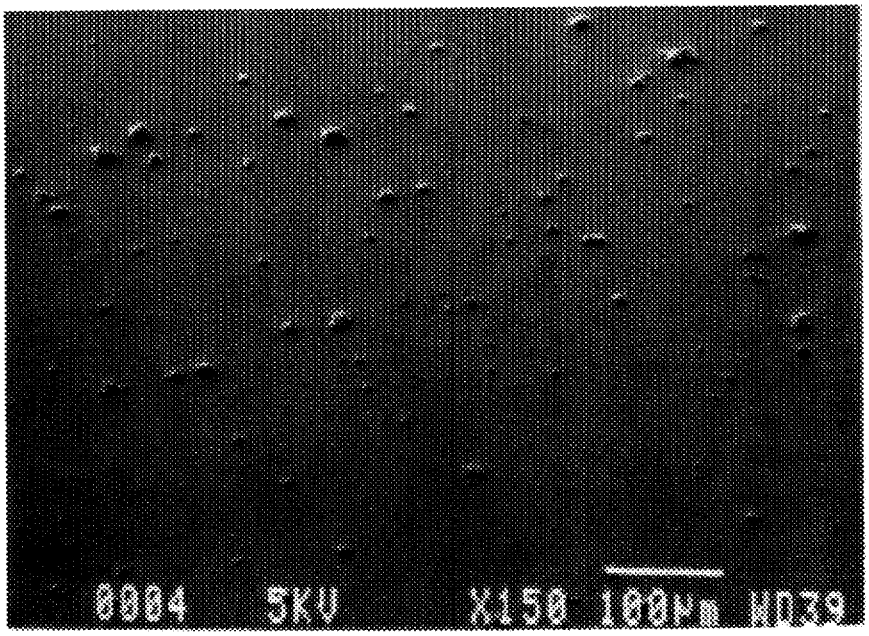
FIG. 2 Prior Art
FIG. 2 is a scanning electron micrograph of an ink jet printing sheet prepared according to Comparison Example A.
Figure 3:
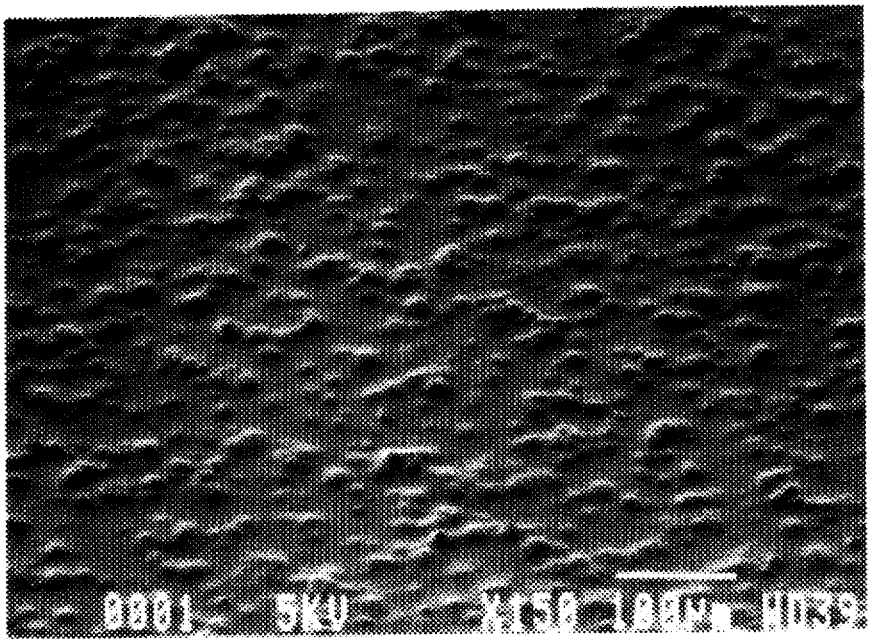
FIG. 3 is a scanning electron micrograph of an ink jet print sheet prepared according to Example 1.
Figure 4:
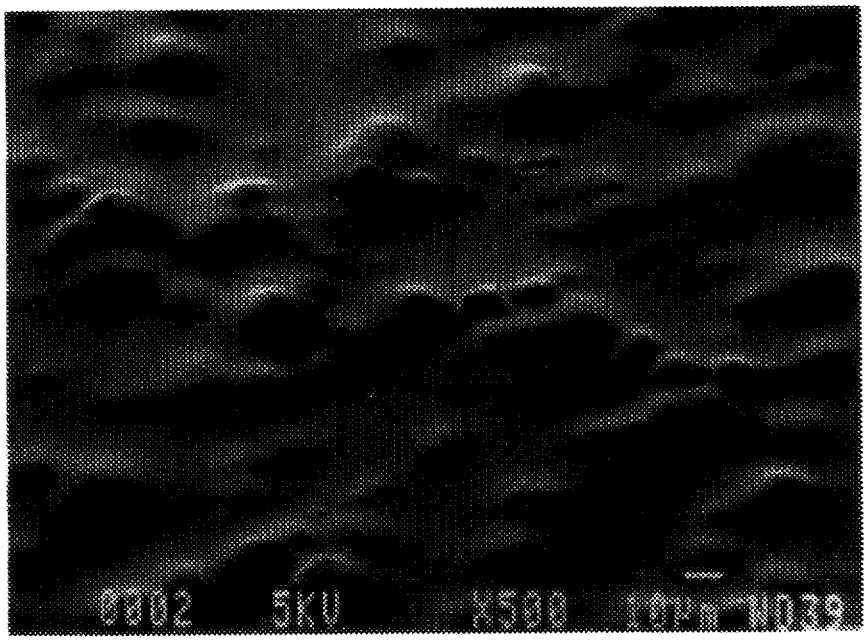
FIG. 4 is another scanning electron micrograph of the sheet shown in FIG. 3.

Referring to the scanning electron micrographs of FIGS. 2–4, the importance of particles (17) and (18) to layers (11) and (12) is shown.

Because ink jet receptor layer (11) contains dispersed particles (17) sized to roughen the surface of the ink jet receptor layer (11) before overcoating with the protective penetrant layer (12), the dispersed particles (17) of the ink jet layer (11) also roughen the surface of the protective penetrant layer (12). This surface roughening comprises protrusions or hills, areas raised above the surrounding receptor surface, that create a terrain or topology conducive to good ink jet printing. Also, the varied terrain or topology provides valleys in which the pigment particles from a printed pigment-based ink may reside.

FIG. 2 (Prior Art) is a scanning electron micrograph with 150 magnification of an ink jet printing sheet prepared according to Comparison Example A described below with particles (18) in layer (12), but no particles (17) in layer (11). The surface has a limited number of protrusions on an otherwise smooth surface.

FIG. 3 is a scanning electron micrograph with 150 magnification of an ink jet printing sheet prepared according to Example 1 described below with particles (18) in layer (12) and with particles (17) in layer (11). The surface has a very roughened terrain and complex topology based on protrusions caused not only by particles (18) in layer (12), but also particles (17) in layer (11).

FIG. 4 is a scanning electron micrograph with 500 magnification of the ink jet printing sheet seen in FIG. 3. In the center of the micrograph, particles (18) are visually distinguishable from particles (17) because the jagged edges of particles (18) contribute "rocky" protrusions to the terrain or topology while the smooth edges of particles (17) contribute "hilly" protrusions to the terrain or topology. Referring again to FIG. 3, it is possible to distinguish the effect of particles (18) from particles (17) because the protrusions in layer (12) from particles (17) are smoother. Referring again to the drawing of FIG. 1, the presence of particles (17) and (18) in layers (11) and (12), respectively, provide unexpected advantages of ink jet printing sheets of the present invention.

An explanation of the effect of both particles (17) and (18) demonstrates those unexpected advantages.

In the ink jet receptor layer (11) (without the protective penetrant layer (12)), the height of the protrusions above the surrounding surface, caused solely by particles contained therein, do not exceed the diameter of the particle. For purposes of explanation, one can define p as the diameter of an ink jet receptor layer particle (17) in nanometers. In a non-spherical particle, this is to be taken as the maximum distance between two points in or at the surface of the particle (17). Therefore the protrusion height above the valleys is<p.

If a coating method for protective penetrant layer (12) provides a uniform coating thickness d onto a uniformly thick substrate, and if this is coated onto the ink jet receptor layer (11) containing the particulates (17) with a roughened terrain, and if d>p and the coating flows out, then the dried protective penetrant layer can fill the valleys between the protrusions, and the image receiving layer (11–12) will have no additional roughening from the particles (17) contained in the lower layer (11) or layers, i.e. the ink jet receptor layer (11). Therefore it is preferred that p>d.

If p>d, it is then possible for the particles (17) in the ink jet receptor layer (11) to roughen the surface of the protective penetrant layer (12) depending on the height of the protrusions. The greater the diameter of the particles (17) added to the ink jet receptor layer (11) compared with the dried thickness of the protective penetrant layer (12), the rougher the surface of the two-layer construction (11–12) providing the ink jet receptor layer (11) contains a sufficient concentration of particles (17). If the image receiving layer (11–12) comprises more than one protective penetrant layer (12), then it desired that the ink jet receptor layer or layers (11) contain particles (17) of diameter exceeding the combined thicknesses of the penetrant layers (11).

The terrain or topology of the surface of the two layer ink jet receptor should be more roughened than pigment particle size in the printed pigmented ink jet ink (15) which resides on the surface of layer (12). If the outer surface is rough (as seen in FIG. 3, compared with FIG. 2), due to particulate (17) in the ink jet receptor layer (11), i.e. there are raised areas whose diameter in the plane of the surface is in the same order of magnitude as that of the diameter of the particles (17), then at least part of the pigment particles(after printing and drying the image) in a patch of dried ink resides below the raised surface of layer (12).

Figure 5:
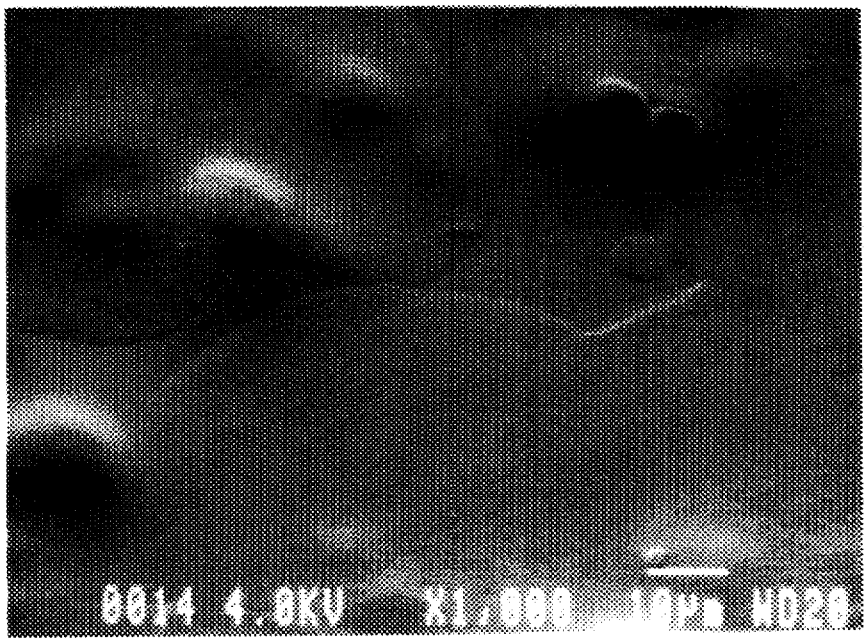
FIG. 5 is another scanning electron micrograph of an ink jet printing sheet of the invention, having an image printed thereon.

FIG. 5 is a scanning electron micrograph with 1000 magnification of an ink jet printing sheet prepared according to Example 1 having patches of dried ink jet ink, within which particles of pigment reside. These patches lay over protrusions and valleys caused by both particles (17) and particles (18). While not limited to a particular theory, it is believed that protrusions caused by particles (17) provide some protection for at least part of the dried ink areas to smear resistance from abrasion which is particularly valuable where the ink used comprises pigment particles. Dyes diffuse into layers 11 and 12, but pigment particles reside on layer 12. Other advantages of surface terrain or topology such as seen in FIGS. 3–5 include prevention of blocking and aiding printer friction feeding.

Some surface roughness may also be achieved with particles (18) in the protective penetrant layer (12). However, if the protective penetrant layer (12) is limited to the preferred thicknesses of this invention, then the particulate-induced roughening of the surface of layer (12) will be limited unless the protective penetrant layer coating solution comprises high concentrations of particles (18) compared with other film-forming penetrant layer constituents. Potential problems with this high particle loading include difficulties in binding of the particles to the surface of the image receiving layer (11–12) and stability of the particle dispersion in the penetrant layer coating solution.

The surface roughening shown in FIGS. 3–5 is easily achieved if the particles (17) are included in the much thicker ink jet receptor layer (11) where the surface roughening achieved from the ink jet receptor layer particles (17) is distinguishable from those particles (18) in the protective penetrant layer. Referring again to FIG. 4, it is visually obvious that the raised areas (protrusions) from the ink jet receptor layer particles (17) is much more frequent (higher frequency per unit area) than that from the protective penetrant layer particles (18) although the particle concentrations of the same cornstarch are 21.5% by weight of the dry protective penetrant layer (12) compared with 16.7% by weight of the dried ink jet receptor layer (11). This difference is because of the much greater thickness of the ink jet receptor layer (11) than that of the protective penetrant layer (12).

The difference in the surface roughness of the materials from Example 1 and Comparison Example A are also evident in gloss measurements included with such examples.

A further advantage can be seen by examining FIG. 5 from Example 1 using the preferred particulate, cornstarch, in this system. The particles (17) of cornstarch of the ink jet receptor layer (11) are wetted with the protective penetrant layer, thereby providing no interference in the wetting properties of the dried protective penetrant layer (12). The control of the wetting properties of the media independently of the absorption properties of the ink jet receptor layer (11) by use of a protective penetrant layer (12) is one of the most important advantages to be gained by a two layer receptor. The addition of a protective penetrant layer as a penetrant layer to an ink jet receptor imparts many advantages as outlined in U.S. Pat. No. 4,379,804, the disclosure of which is incorporated by reference herein.

Preferred dried protective penetrant layer (12) coating weights are in the range of about 0.05 to about 2 $g/m^2$ (approximately five to 200 milligrams per square foot). Assuming densities of 1 $g/cm^3$, this gives preferred thicknesses of protective penetrant layer (12) of 0.05 to 2 μm approximately. Polymer densities can vary between 0.8 and 2.7 grams per cubic centimeter. For example poly(vinyl alcohol), the main constituent of the topcoat in the examples, has a density range of 1.27 to 1.490 (Polymer Handbook, 3rd Edition, J. Brandrup and E. H. Immergut, Wiley-Interscience publication of John Wiley and Sons). The preferred average particle sizes are 2 to 20 μm in diameter thus exceeding the approximate preferred thickness range of the dried protective penetrant layer. The average particle diameter of the preferred particulate, cornstarch, is approximately 20 μm, thus far exceeding the range of topcoat layer (18) thicknesses possible from the preferred range of coating weights.

The ink jet receptor layer (11) thickness and concentration of the particles therein will have a critical effect on the degree of surface roughness, i.e. the number of protrusions per unit area, and the elevation of the peak of the protrusion from the lowest surrounding area or valley. If the ink jet receptor layer (11) were as thin as the protective penetrant layer (12), the frequency of the raised areas of the particulates would be much lower per unit area at the surface of the two layer construction.

In general a thicker ink jet receptor layer (11) absorbs more ink. Dried ink jet receptor layer (11) coating weights are typically between about 2 to about 30 $g/m^2$. Preferred dried ink jet receptor layer (11) coating weights are between about 5 and about 20 $g/m^2$.

Typically particles (17) added to coatings for layer (11) do not have a uniform size, but rather are defined in terms of a particle size distribution with an average particle size. Therefore it is preferred that p average>d where p average refers to average particle size.

Pressure Sensitive Adhesive Layer

Although it is preferable to use a pressure-sensitive adhesive, any adhesive that is particularly suited to the particular substrate (10) selected and end-use application can be used on the ink jet printing sheet. Such adhesives are those known in the art any may include adhesives that are aggressively tacky adhesives, pressure sensitive adhesives, repositionable and/or positionable adhesives, hot melt adhesives and the like. Furthermore, it is permissible to fabricate an ink jet receptor sheet without the addition of an adhesive layer (13), for example, short-run interior signage loaded into a sign box.

Overlaminate Layer

In this application, overlaminate layer (16) refers to any sheet material that can be adhered to the surface of any existing coated or uncoated sheet material. "Overlamination" refers to any process of achieving this adherence, particularly without the entrapment of air bubbles, creases or other defects that might spoil the appearance of the finished article or image.

The deleterious effects of ambient humidity may be slowed by the overlamination of a transparent protective coat or sheet herein referred to as an overlaminate. Overlamination has the further advantage that the images are protected from scratching, splashes, and the overlaminate can supply a high gloss finish or other desired surface finish or design, and provide a degree of desired optical dot-gain. The overlaminate layer (16) may also absorb ultraviolet radiation or protect the underlayers and image from deleterious effects of direct sunlight or other sources of radiations. Overlamination is, for example, described in U.S. Pat. No. 4,966,804.

After printing an image or design onto the receptor layers (11) and (12) of the present invention, the image is preferably overlaminated with a transparent colorless or nearly colorless material. Suitable overlaminate layers include any suitable transparent plastic material bearing on one surface an adhesive. The adhesive of the overlaminate layer could be a hot-melt or other thermal adhesive or a pressure-sensitive adhesive. The surface of the overlaminate layer can provide high gloss or matte or other surface texture. Preferred overlaminate layers are designed for external graphics applications and include materials such as those commercially available from 3M Company as Scotchprint™ 8910 Exterior Protective Film, 8911 Exterior Protective Film, and 8912 Exterior Protective Film. However, other films are available or could be fabricated and the invention is not limited to those exemplified.

Use of the Printing Sheet

An example of a printing process used in the present invention comprises feeding the material in either sheet form or dispensed from a roll into an ink jet printer, printing a desired color or monochrome image, retrieving the image from the printer and, optionally, overlaminating the image with an overlaminating layer to protect the receptor coatings and image from water, scratching and other potential sources of damage to the image, and then removing the release liner (14), and affixing the printed image to a wall, vehicle side, banner, page or other surface for viewing.

Advantageously the articles of the present invention accept pigment-based ink jet inks when the substrate is comprised of weatherable plastic materials, allowing for heat and light stable image constructions under such circumstances as are found in exterior signing environments.

The ink jet printing sheet provide useable images using both dye-based and pigment-based ink jet inks suitable for use, for example, in wide-format ink jet printers wherein both narrow or wide images can be made by ink jet printing process used in signing applications. The resultant printed sheet is easily handleable without easy smearing of the image and can be applied, when an adhesive layer is part of the ink jet printing sheet, to a wall, vehicle side or other surface for signing and other applications using techniques well known in the art without use of other devices such as spray adhesives.

EXAMPLES

The invention is further illustrated by the following examples, but the particular materials and amounts thereof recited in these examples, as well as other conditions and details, should not be construed to unduly limit this invention. All materials are commercially available or known to those skilled in the art unless otherwise stated or apparent.

In the examples described herein, density and optical densities were reflection densities measured using a Gretag SPM-50 densitometer, subtracting the density of the unprinted sheet as background. For reference the following example densities were obtained printing onto Hewlett-Packard HP51631E Special Ink Jet Paper using the Hewlett-Packard Designjet 650C fitted with the HP51650 series cartridges (including the HP51640A black) as recommended for the printer: 1.365 (cyan), 1.154 (magenta), 0.967 (yellow) and 1.247 (black). For reference the following densities were obtained printing onto Hewlett-Packard HP51631E Special Ink Jet Paper using the Hewlett-Packard Designjet 650C fitted with the HP51640 series cartridges (including the HP51640A black): 1.247 (cyan), 1.123 (magenta), 0.686 (yellow) and 1.242 (black).

Example 1

Ink jet printing sheets for dye and pigment-based ink-jet inks were prepared by coating the following formulation onto Scotchcal™ Marking Film Series 3650 available from 3M Company. A formulation was made up by thoroughly mixing until homogeneous; 810 grams of a 20% aqueous solution of copolymer as described in EP 0484016 A1, 469 grams of solid poly(vinyl pyrrolidone), K90 (available from ISP Technologies Inc.), 162 grams of Carbowax Polyethylene Glycol 600 (available from Union Carbide Chemicals and Plastics Company Inc.), 108 grams of a 15% solution of mordant (mordant with chloride counterions as described in U.S. Pat. No. 5,342,688, and PCT Publication WO 94/20304, PCT Publication WO 94/20305, and PCT Publication WO 94/20306, 3560 grams of deionized water and 1638 grams of ethanol. To the mixture was added 167 grams of LOK-SIZE® 30 Cationic Corn Starch (available from A. E. Staley Manufacturing Company). The solution was mixed using an overhead stirrer for four hours, and then homogenized for thirty minutes in a five gallon pail using a Silverson high-speed Multi-Purpose Lab mixer, fitted with a Disintegrating Head.

Before coating, 3.3 grams of 30% aqueous ammonia (available from Aldrich Chemical Company) and then 24.3 grams of Xama 7, (an aziridine crosslinker available from Hoechst Celanese Corporation) were mixed in thoroughly.

The above formulation was coated on an automated pilot coater at a web speed of 0.10 meters per second onto 0.3048 meter wide Scotchcal™ Marking Film Series 3650: a weatherable white vinyl product composed of, in order; a white vinyl layer, a pressure-sensitive adhesive layer, and release paper; available from 3M Co. A knife coater approximately set at a 127 micrometer gap was used and the dried coating weight measured at 14.90 grams per square meter. The material was passed at 0.10 meters per second through four drying zones; 3.66 meters at 65.6° C., 3.66 meters at 79.4° C., 3.66 meters at 93.3° C., and 7.32 meters at 121° C.

In a second pass, a topcoat was overcoated onto the product of the above coating operation onto the previously described coated layer using the pilot coater with knife coater set at a 76 micrometer gap. The topcoat similar to that described in U.S. Pat. No. 4,935,307 was composed of 66% by weight (of the total mixture) deionized water; 1.64% by weight Airvol 540 poly(vinyl alcohol) (available from Air Products) 31.17% by weight of denatured alcohol; 0.61% by weight of LOK-SIZE® 30 Cationic corn starch (available from A. E. Staley Manufacturing Company), 0.28% by weight of Xanthan gum, a polysaccharide gum known as KELTROL TF 1000 (available from Kelco Division of Merck & Co. Inc.), and 0.3 & by weight of Triton X-100 surfactant (available from Union Carbide Chemicals and Plastics Company Inc).

This coated article was passed at 0.10 meters per second through four drying zones; 3.66 meters at 65.6° C., 3.66 meters at 79.4° C., 3.66 meters at 93.3° C., and 7.32 meters at 93.3° C. Images were printed directly onto the receptor coating side of the coated material using a Hewlett-Packard HP650C Design jet ink jet printer fitted with the standard 51650 series of ink cartridges giving excellent densities, quick drying time, smear-resistant colors including the black (printed from the HP51640A cartridge containing a black pigment-based ink.).

One image was overlaminated using Scotchprint™ 8910 Exterior Protective Clear Film, lustre gloss available from 3M Co. using techniques known in the art, giving a gloss image protected against spills. The overlaminate also supplies additional resistance to dye bleed from humid environmental conditions.

Examples of optical densities obtained on samples without overlaminate by measurement with a Gretag SPM-50 hand-held densitometer were 1.294 (cyan), 0.969 (magenta), 0.654 (yellow), and 1.450 (black).

This printing sheet was also printed on an Encad Novajet wide format printer fitted with LaserMaster Corp. inks (all dye-based). Very high densities were obtained, although drying times were longer—on the order of ten minutes to touch dry. Examples of optical densities obtained were 1.857 (cyan), 1.802 (magenta), 1.044 (yellow), and 1.937 (black).

Gloss of the unprinted printing sheet was measured using a BYK-Gardner micro-TRI-gloss glossmeter (available from BYK-Gardner Inc. USA, Silver Spring, Md. 20910). Average of five readings taken on different positions on the surface of the printing sheet gave the following readings at various angles: 20°–2.5, 60°–11.9, 85°–6.8.

Example 2

The article produced as follows illustrates a different type of adhesive backed substrate allowing for short-term removability of images. Bottomcoat solution of the same composition as described in Example 1 was coated on a pilot coater at a web speed of 0.10 meters per second onto roll of 0.30 meter wide Scotchcal™ Series 9000 Short-Term Removable (STR) Film, available from 3M Co. and comprising in order, a white vinyl layer, an adhesive layer (which allows removal for up to two years with little or no adhesive residue from most surfaces), and a release backing.

The bottomcoat was coated onto the vinyl using a knife coater set at a gap of approximately 127 micrometers giving a dried coating weight measured at 15.51 grams per square meter. The material was passed at 0.1 meters per second through four drying zones; 3.66 meters at 65.6° C., 3.66 meters at 79.4° C., 3.66 meters at 93.3° C., and 7.32 meters at 121° C.

The topcoat was as described in Example 1 except that it was further diluted to 1% solids with deionized water. In a second pass, the diluted topcoat was overcoated onto the product of the above coating operation onto the previously coated layer using the pilot coater with knife coater set at a 127 micrometers gap. For the topcoat the web speed was approximately 0.076 meters per second. The topcoat was applied using a crossflow knife. The material was passed at approximately 0.076 meters per second through four drying zones; 3.66 meters at 65.6° C., 3.66 meters at 79.4° C., 3.66 meters at 93.3° C., and 7.32 meters at 121° C.

Color test patterns were printed onto 21.6 by 27.9 centimeter samples of these materials using the Hewlett-Packard Designjet 650C giving fast drying images with and smear-resistant images including pigment black. Test patterns and larger full color images were also printed using the Hewlett-Packard Designjet 650C fitted with Hewlett-Packard 51640 series cartridges, giving fast drying smear-resistant images.

Examples of optical densities measured for 100% color areas are: for HP51650 inks (including the HP51640A black) printed on the Hewlett-Packard Designjet HP650C printer: 0.970 (cyan), 1.013 (magenta), 0.581 (yellow), and 1.125 (black).

Examples of optical densities measured for 100% color areas are: for HP51640 inks printed on the Hewlett-Packard Designjet HP650C printer: 1.367 (cyan), 0.987 (magenta), 0.991 (yellow), and 1.185 (black).

Example 3

The following example illustrates printing sheet acting as receptors for pigment-based inks alone and thus not requiring any mordanting method to slow or prevent dye-bleed. A formulation was made up by thoroughly mixing until homogeneous, 59.8 grams of a 20% aqueous solution of copolymer as described in No. EP 0484016, 34.6 grams of solid poly(vinyl pyrrolidone) K90 available from ISP Technologies Inc., 12 grams of Carbowax Polyethylene Glycol 600 available from Union Carbide Chemicals and Plastics Company Inc., and 263 grams of deionized water. To the mixture was added 121 grams of ethanol and 12.3 grams of LOK-SIZE® 30 Cationic Corn Starch (available from A. E. Staley Manufacturing Company). The corn starch was homogenized using a Silverson L4R Multi-Purpose Laboratory Mixer fitted with a Disintegrating Head for a period of ten minutes.

To 50 grams of the above solution was added one droplet of 30% ammonia (available from Aldrich Chemical Co.) and 0.18 grams of Xama 7 (available from Hoechst Celanese Corporation ) were added and thoroughly mixed in. The resulting mixture was hand coated using a knife or notch bar set at a gap setting of approximately 127 micrometers, and dried in an oven at 93.3° C. for four minutes.

The above coatings were overcoated with the topcoat solution described in Example 1 on the knife using a gap setting of approximately 76 micrometers and dried at 93.3° C. for three minutes. Image areas printed by the Hewlett-Packard Designjet HP640A black were smear-resistant and a sample without 8910 overlaminate (i.e. the least protected from the effects of humid air), was placed in an oven/environmental chamber for 90 hours at 40° C. and 85% humidity, and showed no bleeding of the black or other obvious detrimental effects to the black image areas or sheet. Four images were made and three were overlaminated with Scotchprint™ 8910 Exterior Protective Clear Film, lustre gloss available from 3M Co. using techniques known in the art giving glossy images.

Example 4

The following procedure illustrates functionality at different bottomcoat thicknesses. A bottomcoat formulation was made up as described in Example 1 (but twice the quantities of each material). The material was coated on an automated pilot coater at a web speed of 0.10 meters per second onto a roll of 0.30 meter wide Scotchcal™ Marking Film Series 3650 (available from 3M Company). For 15 minutes, a knife coater approximately set at a 51 micrometer gap was used and the dried coating weight measured at 5.60 grams per square meter. Then for a further 15 minutes, the knife coater was set approximately at a 76 micrometer gap, and the dried coating weight measured at 9.16 grams per square meter. Then for another 15 minutes, the knife coater was set approximately at a 102 micrometer gap, and the dried coating weight measured at 13.3 and again at 13.5 grams per square meter. All material was passed at 0.10 meters per second through four drying zones; 0.37 meters at 65.6° C., 3.66 meters at 79.4° C., 3.66 meters at 93.3° C., and 7.32 meters at 121° C.

In a second pass, the topcoat (formulation as described in Example 1) was overcoated onto the product of the above coating operation onto the previously described coated layer using the pilot coater with knife coater set at a 76 micrometer gap at a web speed of 0.10 meters per second through four drying zones; 3.66 meters at 65.6° C., 3.66 meters at 79.4° C., 3.66 meters at 93.3° C., and 7.32 meters at 121° C.

Test pattern images were printed using the Hewlett-Packard Designjet 650C fitted with Hewlett-Packard 51640 series cartridges, giving fast drying smear-resistant images at all coating weights. The following table illustrates the optical densities:

| Weight/g/sq.m | 5.6 | 9.2 | 13.4 |
|---|---|---|---|
| Gap/micron | 51 | 76 | 102 |
| Dc | 0.744 | 0.604 | 0.694 |
| Dm | 0.65 | 0.619 | 0.671 |
| Dy | 0.738 | 0.731 | 0.671 |
| Dk | 1.143 | 1.124 | 1.237 |

Example 5

A bottomcoat formulation containing silica was prepared by thoroughly mixing until homogeneous, 11.95 grams of a 20% aqueous solution of copolymer as described in 3M patent application no EP 0484016 A1, 6.92 grams of solid poly(vinyl pyrrolidone) K90 (available from ISP Technologies Inc.), 2.39 grams of Carbowax Polyethylene Glycol 600 (available from Union Carbide Chemicals and Plastics Company Inc.), 1.59 grams of 15% aqueous polymeric mordant solution (mordant with chloride counterions as described in Example 1, 52.6 grams of deionized water and 24.2 grams of ethanol. The mixture was stirred with an overhead air-driven stirrer and 2.46 grams of Aerosil 380 silica (available from Degussa Corporation Silica Division). 0.05 grams of 30% ammonia (available from Aldrich Chemical Co.) and 0.36 grams of Xama 7, (available from Hoechst Celanese Corporation ) were added to the above solution, and thoroughly mixed in.

The resulting mixture was hand coated using a knife or notch bar set at a gap setting of approximately 127 micrometers, and dried in an oven at 93.3° C. for four minutes.

The above coatings were overcoated with the topcoat solution described in Example 1 on the knife using a gap setting of approximately 51 micrometers and dried at 93.3° C. for three minutes.

Test patterns were printed on a Hewlett-Packard HP650C fitted with the HP51650 series ink cartridges and the HP51640A black ink cartridge. Good smear-resistant images and quick ink drying were obtained. Examples of densities are 0.718 (cyan), 0.663 (magenta), 0.509 (yellow), and 1.007 (black).

Comparison Example A

The following example illustrates a different mordant, and bottomcoat without a dispersed particulate. This formulation gives excellent images with dye-based ink jet inks, but images or parts of images printed using pigment-based ink jet inks remain smearable for an unreasonable time, e.g. in excess of 48 hours. A bottomcoat formulation was made up as described in Example 1 with twice the quantities of each material. However, a different mordant was used than in EXAMPLE 1. The mordant used was a 15% solution of mordant with one equivalent of chloride ion and one equivalent of trifluoroacetate ion as described in Example 1. The material was coated on an automated pilot coater at a web speed of 0.043 meters per second onto a roll of 0.30 meter wide Scotchcal™ Marking Film Series 3650 (available from 3M Company). A knife coater approximately set at a 127 micrometer gap was used and the dried coating weight measured at 10.84 grams per square meter.

All coated articles were passed at 0.043 meters per second through three heated drying zones; 3.66 meters at 79.4° C., 3.66 meters at 121° C., and 3.66 meters at 121° C.

In a second pass, the topcoat (formulation as described in Example 1) was overcoated onto the product of the above coating operation onto the previously described coated layer using the pilot coater with knife coater set at a 51 micrometer gap at a web speed of 0.043 meters per second through three heated drying zones; 3.66 meters at 65.6° C., 3.66 meters at 79.4° C., and 3.66 meters at 93.3° C.

Test plots were directly printed onto the resulting material (aqueous coating side) on a Hewlett-Packard HP650C Designjet printer fitted with the 51650 series color cartridges (cyan, magenta and yellow) and the 51640A cartridge (for black ink). Good images were obtained, but not as good as those obtained with materials of the type exemplified in examples 1, 2, 3, 4, 5 and 6 in the respect that black areas of the images (i.e. those areas printed with the pigment-based ink from the HP51640A cartridge) could be easily smeared using the described method for an unreasonable time after printing herein deemed as in excess of 48 hours. Examples of densities obtained are 0.820 (cyan), 0.667 (magenta), 0.591 (yellow) and 1.310 (black).

Gloss of the unprinted printing sheet was measured using a BYK-Gardner micro-TRI-gloss glossmeter (available from BYK-Gardner Inc. USA, Silver Spring, Md. 20910). Average of five readings taken on different positions on the surface of the printing sheet gave the following readings: 20°–45.5, 60°–80.7, 85°–74.5. Gloss was much higher at all angles than those in Example 1 with cornstarch particles (17) added to the ink jet receptor layer (11).

Example 6

The following example illustrates a different plastic material, adhesive and release paper construction. On the same occasion as outlined in Example 4, the same formulations were coated using the same pilot-scale coating apparatus onto a web approximately 0.41 meters wide comprising a layer of white Surlyn™ plastic, a layer of removable adhesive and a release paper as described in U.S. Pat. Nos. 5,198,301; 5,196,246 and 4,994,322. The material was coated on an automated pilot coater at a web speed of 0.10 meters per second. Various coating weights were used, but in this example the knife coater gap was set at a 102 micrometers gap approximately. This coated material was passed at 0.10 meters per second through four drying zones; 3.66 meters at 79.4° C., 3.66 meters at 79.4° C., 3.66 meters at 93.3° C., and 7.32 meters at 93.3° C.

In a second pass, the topcoat (formulation as described in Example 1 and Example 4) was overcoated onto the product of the above coating operation onto the previously described coated layer using the pilot coater with knife coater set at a 76 micrometers gap at a web speed of 0.10 meters per second through four drying zones; 3.66 meters at 79.4° C., 3.66 meters at 79.4° C., 3.66 meters at 93.3° C., and 7.32 meters at 93.3° C.

Test pattern images were printed using the Hewlett-Packard Designjet 650C fitted with Hewlett-Packard 51650 series cartridges, giving fast drying smear-resistant images. Examples of densities obtained are: 0.978 (cyan), 0.834 (magenta), 0.624 (yellow) and 1.117 (black).

Comparison Example B

The following exemplifies that plastic materials with adhesive and release support without the receptor layers of the invention do not behave satisfactorily as ink jet receptor materials with aqueous ink jet inks. Letter size sheets (21.6×27.9 centimeter) of the following materials were fed into a Hewlett-Packard HP650C Designjet ink jet printer. Printing was attempted with the printer fitted with the HP51640 set of ink cartridges (with the HP51640A black cartridge), and then attempted with the HP51650 set of cartridges (including the BP51640A black cartridge).

Materials tested were Scotchcal™ Marking Film Series 3650, Scotchprint™ 8620 Marking Film, Scotchprint™ 8640 Marking Film all available from 3M Co. and a material comprising a layer of white Surlyn™ plastic, a layer of adhesive allowing for removability, and a release paper as described in U.S. Pat. Nos. 5,198,301; 5,196,246 and 4,994,322. The coating of this latter material to allow ink jet ink reception is described in Example 6.

Inks beaded on the surface of the plastic i.e. did not penetrate to any great extent or at all, and did not wet the plastic surface giving an discontinuous image and low densities. The slightest touch of the finger caused the image to smear. This was still true after 18 hours after printing. The above observations were true of both the dye-based inks and the HP51640A pigment-based black.

Example 7 and Comparison Example C

A roll of film coated as described in Example 1 was stored in a laboratory for 532 days together with the roll of film (therefore same ambient conditions) coated as described in Comparison Example A which had been coated 17 days earlier than that in Example 1 and stored therefore for a total of 549 days. The sheet from this Comparison Example A (without the particles in the ink jet receptor layer (11)) showed some blocking at the edges, and when unwound, fibers from the paper liner stuck to the penetrant layer (12) surface. By comparison, the sheet from Example 1 unwound smoothly.

Four cutout discs of sheet from Example 1 were stacked in register on four discs of sheet from Comparison Example A. All the discs were the same diameter (6.6 cm) and approximately circular. The stack was placed on a board in an environmental chamber maintained at 90° F. at 90% relative humidity, and a cylindrical weight placed flat-side down onto the stack. The weight was of a greater diameter than the discs and weighed 2,681.7 grams, thus giving a pressure of approximately 196 kilograms per square meter (1.1 pound per square inch). After 184 hours the stack was removed, and the discs peeled apart. In all cases there was some sticking of one disc to the next.

The material from Example 1 peeled apart fairly easily, and there was no surface impressioning of the ink jet receptor surface evident. The four discs from Comparison Example A material were harder to peel apart, surface impressions were made on the surface of the surface of the penetrant layer, and in one case the paper of the liner was ripped by contact with the surface of the image receiving layer of material from Comparison Example A. This test showed the improvement in blocking at high ambient temperature and humidity conditions obtained from the addition of particulates into the ink jet receptor layer (11).

For an appreciation of the scope of the invention, the claims follow.

We claim:

1. An ink jet printing sheet comprising a substrate and an image receiving layer contacting the substrate, wherein the image receiving layer comprises at least one protective penetrant layer of one composition and at least one ink jet receptor layer of a second composition wherein the ink jet receptor layer contacts the substrate and the protective penetrant layer contacts the ink jet receptor layer, wherein each ink jet receptor layer and each protective penetrant layer contain dispersed particles or particulates of a size that causes protrusions from the protective penetrant layer, wherein particles or particulates are present in both the ink jet receptor layer and the protective penetrant layer in the range of about 15 to about 25 percent by weight total solids, and wherein the protrusions caused by dispersed particles or particulates in the ink jet receptor layer are visually distinguishable from the protrusions caused by dispersed particles or particulates in the protective penetrant layer.

2. The ink jet printing sheet according to claim 1, wherein the dispersed particulate is a cornstarch or modified cornstarch.

3. The ink jet printing sheet according to claim 1, wherein the protective penetrant layer is thinner than the largest size of dispersed particulate in the ink jet receptor layer.

4. The ink jet printing sheet according to claim 1, wherein the substrate is an opaque or translucent plastic sheeting wherein the sheeting comprises poly(vinyl chloride).

5. The ink jet printing sheet according to claim 1, further including an adhesive layer adjacent to the substrate and on the surface of the substrate opposite the image receiving layer.

6. The ink jet printing sheet according to claim 1, wherein average particle diameter of the dispersed particles or particulates ranges from about 1 to 40 μm, wherein the thickness of the protective penetrant layer ranges from about 0.05 to about 4 μm, and wherein the thickness of the ink jet receptor layer ranges from about 2 to about 30 μm, whereby at least some of the dispersed particles or particulates in the ink jet receptor layer cause protrusions from the ink jet receptor layer and cause protrusions from the protective penetrant layer.

7. The ink jet printing sheet according to claim 1, wherein the protective penetrant layer has a dried coating weight in the range of about 0.05 to about 4 $g/m^2$.

8. The ink jet printing sheet according to claim 1, wherein the ink jet receptor layer has a dried coating weight in the range of about 2 to about 30 $g/m^2$.

9. The ink jet printing sheet according to claim 8, wherein the ink jet receptor layer has a dried coating weight in the range of about 5 to about 20 $g/m^2$.

10. The ink jet printing sheet according to claim 1, wherein the protrusions from the protective penetrant layer are more jagged than the protrusions from the ink jet receptor layer.

* * * * *